United States Patent [19]

Coulston

[11] 4,267,673

[45] May 19, 1981

[54] HEAT INSULATING FLASHING

[75] Inventor: Ellwin L. Coulston, Niles, Mich.

[73] Assignee: Kawneer Company, Inc., Niles, Mich.

[21] Appl. No.: 12,284

[22] Filed: Feb. 15, 1979

[51] Int. Cl.[3] ..... E04D 13/00; E06B 1/62

[52] U.S. Cl. ..... 52/97; 49/DIG. 1; 52/309.1; 52/309.9; 52/403; 52/408; 52/732; 428/57; 428/58

[58] Field of Search ..... 49/DIG. 1; 52/97, 309.9, 52/403, 408, 411–413, 732, 573, 309.1; 428/57, 58, 463, 465

[56] References Cited

U.S. PATENT DOCUMENTS

| | | | |
|---|---|---|---|
| 2,482,170 | 9/1949 | Gunnison | 52/97 |
| 3,241,272 | 3/1966 | Edwards | 52/413 X |
| 3,470,662 | 10/1969 | Kellman | 52/573 |
| 3,778,306 | 12/1973 | Stow | 428/465 X |
| 4,077,926 | 3/1978 | Sanderson et al. | 428/463 X |

FOREIGN PATENT DOCUMENTS

| | | | |
|---|---|---|---|
| 262958 | 10/1965 | Australia | 52/309.13 |
| 585186 | 1/1947 | United Kingdom | 428/58 |

*Primary Examiner*—Alfred C. Perham
*Attorney, Agent, or Firm*—Mason, Kolehmainen, Rathburn & Wyss

[57] ABSTRACT

Heat insulating flashing for building walls, curtain walls, windows and the like includes an inner metal element having an outer edge, an outer metal element having an inner edge in spaced apart relation with said outer edge of said inner metal element, and a joining element of heat insulating material continuously interconnecting the metal elements between the spaced apart edges thereof.

18 Claims, 7 Drawing Figures

HEAT INSULATING FLASHING

BACKGROUND OF THE INVENTION

1. Field of the Invention

The present invention relates to a new and improved, heat insulating, flashing and more particularly to a new and improved heat insulating flashing of the type especially adapted for use in building walls, curtain walls, windows and the like of the type having framing members with a heat insulating thermal barrier between the inner and outer metal elements thereof to minimize heat loss and to minimize or eliminate moisture, condensation or frost from forming on the inner member during periods of cold weather.

The heat insulating flashing of the present invention is especially adapted for use in building curtain wall structures and windows, etc. of the type employing elongated framing elements of the heat insulating type such as those shown in copending U.S. Patent Applications, Ser. Nos. 880,710, filed Feb. 23, 1978 and 007,883 filed Jan. 31, 1979 and 907,305, filed May 18, 1978, which applications are incorporated herein by reference.

2. Description of the Prior Art

In recent years, with the advent of energy shortages, it has been increasingly more economical to provide building walls, curtain wall systems, windows and the like with heat insulating thermal barriers between the inside and outside elements for reducing heat transfer between these elements during heating and cooling seasons. In addition to the use of multiple pane type insulating glass and/or insulating type panels having improved heat insulating characteristics, it has also been desirable to provide heat insulating type, structural frame elements for supporting the panels so that heat losses through the entire wall areas are minimized and the problems of moisture condensation or frost formation on the inside members of a building wall structure are eliminated or greatly reduced.

As far as is known, none of the existing heat insulating building wall and window systems proposed or constructed have included a flashing member, which itself is provided with a thermal barrier or heat insulating element therein for reducing heat losses and preventing the formation of condensation or frost on the interior portion of the flashing.

OBJECTS OF THE PRESENT INVENTION

It is therefor an object of the present invention to provide a new and improved heat insulating flashing, and more particularly, a new and improved heat insulating flashing adapted to reduce heat transfer between inner and outer portions and designed to prevent or reduce the formation of moisture condensation or frost on the interior portions of the inner member within the building during periods of cold weather.

It is an object of the present invention to provide a new and improved heat insulating flashing which is especially designed or adapted for use in heat insulating type curtain wall/window systems as shown in the aforementioned copending patent applications for further improving the operating characteristics thereof.

Yet another object of the present invention is to provide a new and improved heat insulating flashing having a joining element formed of heat insulating material continuously interconnecting the inner and outer metal elements of the flashing.

Yet another object of the present invention is to provide a new and improved, heat insulating flashing of the character described wherein both a heat insulating joining element and a dead air space are provided between the inner and outer metal elements of the flashing to form an effective, heat insulating thermal barrier.

Another object of the present invention is to provide a new and improved heat insulating flashing which functions both as an effective water flashing member and in addition, prevents or reduces formation of moisture condensation and/or frost on the inside portions thereof.

Yet another object of the present invention is to provide an improved method of making insulating flashing of the character described.

Yet another object of the invention is to provide a new and improved apparatus for making heat insulated flashing of the character described.

SUMMARY OF THE INVENTION

The foregoing and other objects and advantages of the present invention are accomplished in a new and improved heat insulating flashing which includes an inner metal element having an outer edge and an outer metal element having an inner edge in spaced apart confronting relation with the outer edge of the inner metal element, and a joining element formed of heat insulating material continuously interconnecting the inner and outer metal elements between the spaced apart edges thereof. The heat insulating flashing is preferably utilized with heat insulating type wall framing members in curtain wall systems or windows and functions both to divert moisture to the outside of the building, and to reduce heat transfer while at the same time reducing or eliminating the formation of moisture condensation or frost on an inside surface portion of the flashing.

A novel method is provided for making the insulating flashing and a novel apparatus is provided for practicing the method of making the insulating flashing herein disclosed. The novel method provides for the positioning of a pair of inner and outer metal flashing elements with their facing edges in a spaced apart, aligned, confronting relation and applying thereto a joining element formed of heat insulating material for interconnecting the metal flashing elements between the spaced apart edges.

The novel apparatus for making the heat insulating flashing includes a guide means for aligning the inner and outer metal flashing elements to move longitudinally along parallel paths with their facing edges in confronting, spaced apart, alignment and an applicator for biasing a joining element transversely against the longitudinally moving inner and outer metal elements for permanently interconnecting the metal elements across the spaced apart edges to form the finished heat insulating flashing.

BRIEF DESCRIPTION OF THE DRAWINGS

For a better understanding of the present invention, reference should be had to the following detailed description taken in conjunction with the drawings, in which:

FIG. 6 is a fragmentary, transverse, cross-sectional view taken substantially along lines 6—6 of FIG. 3.

DESCRIPTION OF THE PREFERRED EMBODIMENTS

Figure 2:
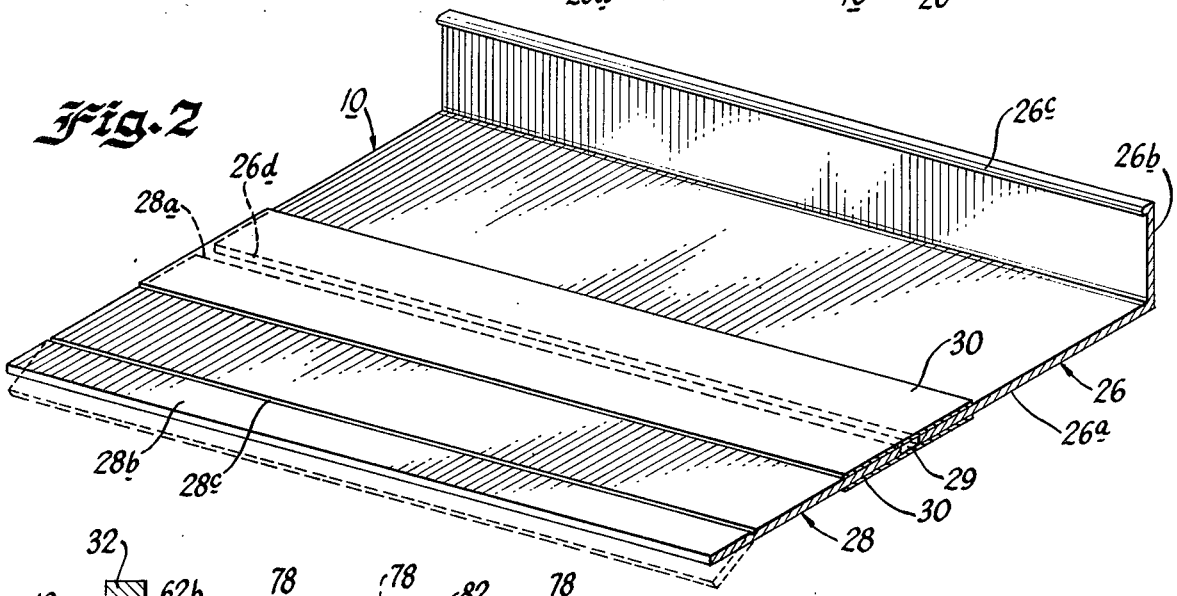
FIG. 2 is a perspective view of a short length of new and improved heat insulating flashing constructed in accordance with the features of the present invention.

Referring now more particularly to the drawing, in FIG. 2 is illustrated a short length of a new and improved flashing member constructed in accordance with the features of the present invention and referred to generally by the reference numeral 10. The flashing 10 is fabricated in relatively long strips which are usually cut to an appropriate length at the job site as required for flashing along the lower edge of a wall structure or window opening and the like.

Figure 1:
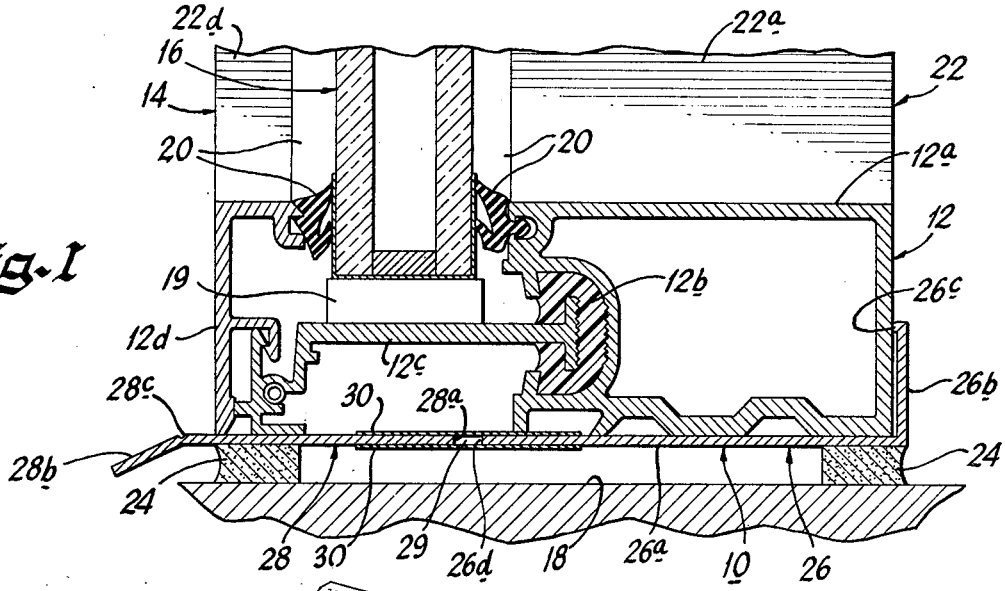
FIG. 1 is a vertical cross-sectional view of a building/curtain wall structure utilizing new and improved heat insulating flashing constructed in accordance with the features of the present invention.

The flashing strip in accordance with the present invention is designed for the purpose of collecting and directing any moisture that is present internally of a wall system or window system to the outside of the building structure. In FIG. 1 is illustrated a typical installation utilizing a strip of heat insulating flashing 10 and the flashing strip is especially designed to be used in conjunction with a heat insulating type sill framing member 12 and a heat insulating type curtain wall system 14 which includes a plurality of dual pane insulating type glass panels 16.

The flashing strip is used along the lower edge of an opening 18 in the building wall, which opening is covered with the curtain wall structure as illustrated. The wall structure 14 is described and illustrated more fully in the aforementioned copending U.S. patent applications and reference should be had to these applications for a more detailed treatment if desired. The insulating flashing of the present invention is also useful as a conventional flashing strip and can be used with other types of non-insulating type curtain walls, building walls, windows and the like, wherein it is desirable to reduce heat transfer through the flashing member itself for minimizing heating and cooling costs and for eliminating or greatly reducing the possiblity of moisture condensation or frost formation on portions of the flashing strip inside the building structure.

Briefly, the elongated, composite sill member 12 of the wall structure includes a hollow, tubular, inner metal element 12*a* formed with a pocket for receiving a heat insulating joining element 12*b* which in turn interconnects and supports an outer, metal element 12*c* having a horizontal web supporting an insulating glass panel 16 or other type of insulating wall panel. For support of the panel, glazing blocks 19 are mounted on the web, preferably at quarter points along the lower edge of the supported panel. The insulating type sill member 12 also includes a detachable, outer sill face 12*d* and a pair of elongated, sealing strips or glazing wedges 20 are provided on the respective inside metal element 12*a* and the outer sill face 12*d* for sealing around the perimeter of the glass panel on both the inner and outer faces thereof as illustrated.

The wall structure 14 also includes vertically extending composite frame members such as jambs or mullions 22 which are interconnected with the horizontal sill 12 and which are generally provided with inner and outer metal elements 22*a* and 22*d*, respectively, structurally interconnected, yet heat insulated from one another by a heat insulating joining member (not shown) similar to the heat insulating member 12*b* in the pocket of the sill element 12*a*.

The flashing strip 10 is of a generally L-shaped, transverse, cross-section as shown in FIGS. 1 and 2, and the underside thereof is sealed against the surface of the adjacent opening 18 by one or more strips of caulking material 24 which are gunned in place in a conventional manner.

In accordance with the present invention, the novel, heat insulating flashing strip includes an inner or inside metal element 26 of generally L-shaped, transverse cross-section including a horizontal or bottom wall segment 26*a* and an upstanding vertical flange or dam 26*b* having an enlarged bead or stiffening rib 26*c* integrally formed along the upper edge of the dam as shown in FIGS. 1 and 2. Preferably, the inner metal element 26 is formed of extruded aluminum and includes an outwardly facing, outer terminal edge 26*d* which is disposed in facing, spaced apart, relation with an inwardly facing terminal edge 28*a* of an outer or outside metal flashing element 28 in coplanar alignment with the bottom wall segment 26*a* of the inside element. Between the facing, spaced apart, terminal edges 26*d* and 28*a* there is formed an open space or air pocket 29 of rectangular transverse cross-section which provides a heat barrier or thermal break between the respective inner and outer metal elements 26 and 28 of the composite flashing strip 10. In accordance with the present invention, the flashing strip includes an intermediate, joining element of heat insulating material comprising a pair of upper and lower elongated strips 30 secured to the aligned coplanar upper and lower faces of the metal elements 26 and 28 adjacent the respective terminal edges 26*d* and 28*d*. The insulating tape strips 30 provide a structural interconnection between the inner and outer metal elements 26 and 28 to form the composite flashing strip 10 and at the same time form a thermal barrier between these elements which greatly improves the thermal characteristics of the flashing. The dead air space 29 also adds to the effectiveness of the thermal barrier and the tape strips 30 positively define the upper and lower walls of the air space.

Referring momentarily to FIG. 1, it is seen that when the flashing strip 10 is in place in the wall structure 14, the inner metal element 26 is in direct contact with the respective inside metal portion 12*a* of the sill member 12 and the outer, metal flashing element 28 is in direct contact with the outside metal elements 12*c* and 12*d* of the sill. Accordingly, the contacting pairs of metal elements of the flashing and sill on the inside of the building, and the contacting pairs of metal elements of the flashing and sill on the outside of the building are thermally isolated from one another by the dead air space 29 and tapes 30 of the flashing, and the heat insulating joining element 12*b* of the sill member. Consequently, there are no conductive heat paths through metal elements formed between these pairs of respective, inside and outside metal elements. Moreover, because both the sill or structural framing member of the wall and the flashing strip are provided with insulating thermal barriers, the possibility of moisture condensation or frost formation of the inner or inside metal elements is greatly reduced even though cold weather is extreme. When a conventional, all-metal flashing member is used in conjunction with a heat insulating type sill and/or wall structure, the all-metal flashing member often serves as a heat path short circuit and reduces the overall thermal effectiveness of the heat insulating frame member and the wall structure as a whole. In addition, moisture condensation and frost problems may develop with an all-metal member. When the heat insulating, flashing element 10 is utilized, however, both the sill and the flashing have a heat barrier or thermal break and these are in parallel to provide the overall structure with a highly efficient thermal barrier to minimize heat transfer between the inner and outer metal elements.

The insulating joining strips 30 are formed of flexible, resinous plastic material having a pressure sensitive adhesive on one face and the material used for the tape strips is chosen to be tough, strong, impervious to water, and has a relatively low coefficient of heat conductivity in comparison to the heat conductivity of the metal elements 26 and 28 which may be relatively high. Tapes formed of polyvinyl chloride and polyethylene resin have been utilized successfully and pressure-sensitive type, low creep, synthetic adhesive as well as rubber based adhesives have worked well. Tape strips with a thickness in mils of 5.5, 6 and 14, respectively, have been effective and these thicknesses have respective tensile strengths in pounds per inch of tape width of 10, 18 and 20. The tapes also have excellent adhesion test characteristics as measured for adhesion to steel in ounces per inch of width of 30, 25 and 35, respectively.

In one embodiment of the present invention, the tape strips 30 are an inch and a half in width and are formed of a 6 mil thick, polyvinyl chloride resin with a pressure sensitive adhesive. The spaced apart, confronting edges **26*d* and 28*a* are spaced by a distance of approximately three-sixteenths of an inch. Polyethylene tape with a rubber based adhesive, an inch and a half in width and 14 mils in thickness has also been used for making the new and improved flashing strip 10** in accordance with the invention.

In accordance with another aspect of the invention, the outside metal element 28 of the flashing strip 10 is provided with a downwardly deflectable, drip edge portion **28*b* along the outer margin and for the purpose of facilitating the downward deflection of the drip edge, a groove 28*c* is formed in the upper surface along a line spaced a short distance outwardly of the outer face member 12*d* of the adjacent sill member 12. After the flashing strip 10 is installed and the sill member 12 of the wall structure 14 is secured in place thereon, the outer drip edge 28*b* of the flashing is deflected downwardly as illustrated in FIGS. 1 and 2. The amount of downward deflection can be adjusted on site to accommodate the surroundings. Leaving the outer metal element 28 of the flashing in the flat condition until actually in place, aids in the shipment and packaging of the flashing strips 10**.

Referring now to FIGS. 3–7, insulating flashing strips 10 are fabricated by positioning a pair of elongated metal elements 26 and 28 to move along longitudinally parallel paths while a pair of upper and lower adhesive tape strips 30 are applied simultaneously onto aligned coplanar upper and lower faces of the members by resilient pressure executed in a direction normal to the path of travel. The upper and lower tapes 30 span the air space 29 between the facing edges **26*d* and 28*a* of the metal elements and structurally interconnect the metal elements to form the composite flashing member 10**.

An apparatus for manufacturing the flashing strips 10 and practicing the method as described includes a rectangular base 32 supported in vertically upstanding position as shown and formed with a rectangular slot or opening **32*a* through which a flashing strip is fed while moving along a horizontal path with the metal elements 26*a* and 28** in aligned coplanar, spaced apart, parallel relation.

An upper tape applicator assembly 34 is supported on the base 32 above the slot **32*a* and a lower tape applicator 36 is secured to the base below the slot 32*a* and, in addition, the apparatus includes a supporting guide structure for guiding support of the elongated metal elememts 26 and 28 for movement along parallel, spaced apart, horizontal paths through the slot 32*a***.

The upper tape applicator 34 includes a pair of parallel, slotted side walls 40 spaced apart to accommodate an upper roll of tape 30 which is disposed therebetween. The tape is supported on a rotatable spindle or axle 42 which is removably and slidably received in a pair of aligned, horizontal slots **40*a* opening on the outer edges of the side walls. Each side wall also includes a right angle mounting flange 40*b* secured to the base plate 32 by a pair of cap screws 44. The upper roll of tape 30 is retained in position with the spindle 42 against the blind end of the slots 40*a* by means of a pair of deflectable, detent springs 46, one on each wall, and the springs permit free rotation of the tape roll spindle 42 yet retain the spindle in position during rotation as shown in FIG. 3** while the tape is unwound in a counterclockwise direction as illustrated by the arrow "A".

Below the upper tape roll 30, the side walls 40 are formed with elongated slots **40*c* positioned in vertical alignment below the tape spindle 42 and each slot thus provides a vertical guideway for slidably supporting a flanged, tubular bearing element 48 in which is journaled the outer end portion of a rotating shaft 50. The shaft supports a tape backing applicator roll 52 formed of resilient material and adapted to bias the back or non-adhesive side of the tape downwardly against the upper surface of adjacent marginal edge portions on the elongated, inner and outer metal elements 26 and 28** which are moved through the apparatus.

The applicator roll 52 is resiliently biased in a downward direction toward the travel path of the metal elements 26 and 28 by a pair of coil springs 54, each spring having a lower end seated in a recess formed in a bearing sleeve 48 and an upper end centered against the lower end portion of an externally threaded, bias adjusting screw 56. Each bias adjusting screw is threadedly received and supported in a central, vertical bore formed in a support bracket 58 secured to the outside surface of a respective side wall 40 by a pair of cap screws 60. By adjusting the position of the set screws 56 in the brackets 58, the amount of compression exerted by the springs 54 on the applicator roll 52 and consequently the amount of pressure applied to the pressure sensitive adhesive of the upper tape 30 is adjustable so that the desired bond between the upper tape strip and the upper surfaces of the metal flashing elements 26 and 28 is selectively controllable.

Figure 5:
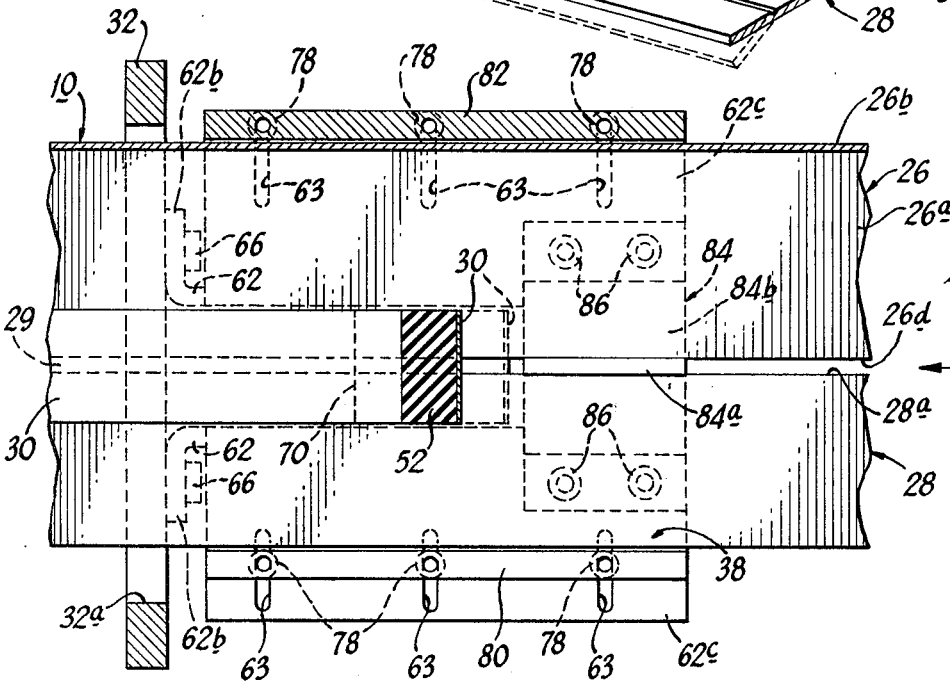
FIG. 5 is a horizontal, cross-sectional view taken substantially along lines 5—5 of FIG. 3.
Figures 3, 4, 5, 7:
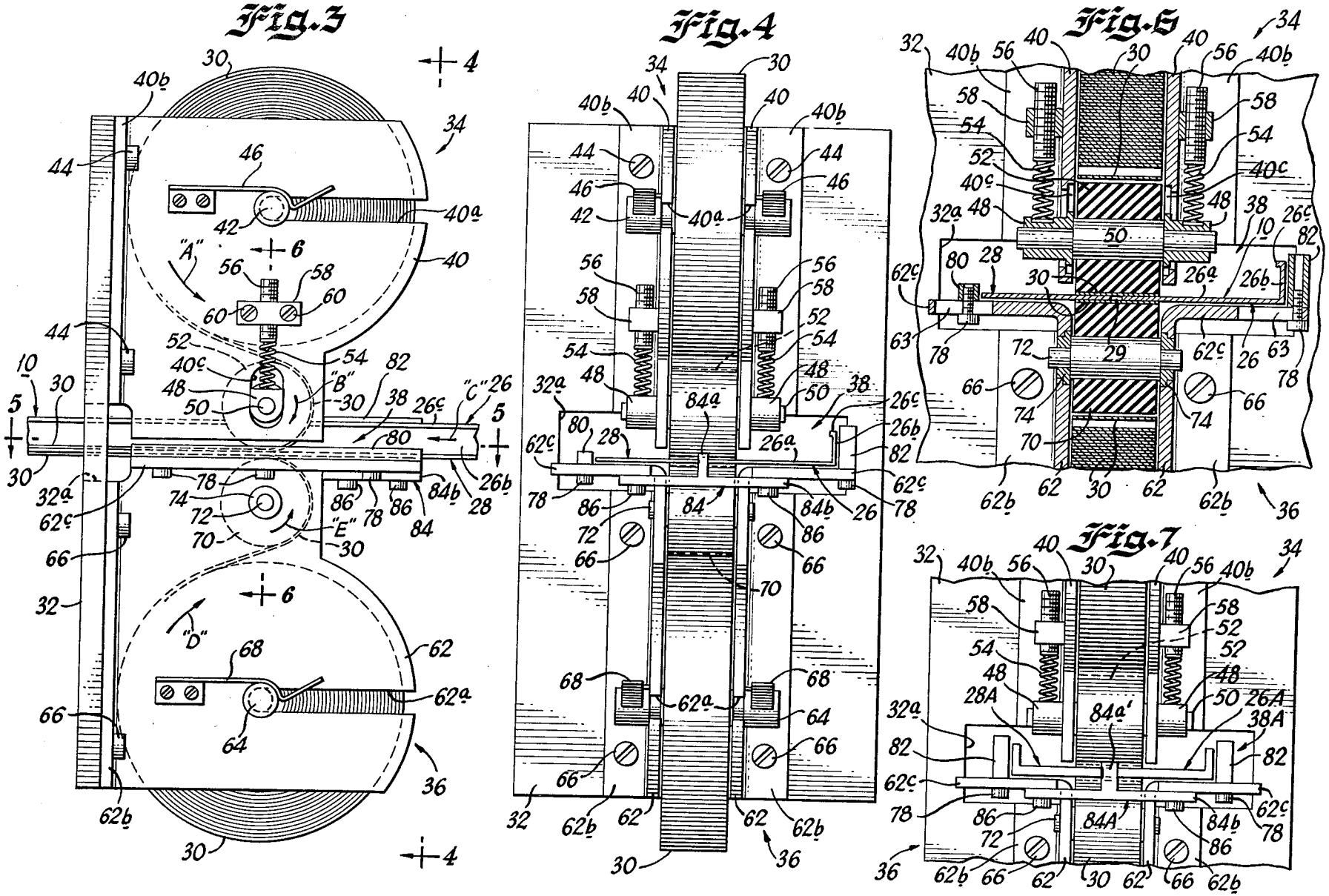
FIG. 3 is a side elevational view of a new and improved apparatus for making heat insulating flashing in accordance with the features of the present invention.
FIG. 4 is a transverse, cross-sectional, view taken substantially along lines 4—4 of FIG. 3.
FIG. 7 is a transverse, cross-sectional view similar to FIG. 4, illustrating the apparatus of FIG. 3 with a modified guide thereon for use with elements of a different cross-sectional shape.

As illustrated in FIG. 3, the backside of the upper tape runs in contact with the outer surface of the upper resilient applicator roller 52 which rotates in a clockwise direction as indicated by the arrow "B" as the metal elements 26 and 28 move linearly along the horizontal travel path as indicated by the arrow "C".

The lower tape applicator 36 includes a similar pair of opposite, spaced apart, parallel, vertical, side walls 62, each having a horizontal slot 62*a* for supporting a spindle or axle 64 of a lower roll of tape 30. The sidewalls 62 are formed with vertical, right angle flanges 62*b* secured to the base plate 32 below the slot 32*a* with cap screws 64. The lower roll of tape 30 is secured in an operative rotative position between the sidewalls 62 by a pair of deflectable detent springs 68 similar to the upper pair of springs 46. As the lower tape is applied to the underside of the metal flashing elements 26 and 28, the roll rotates in a clockwise direction as indicated by the arrow "D", and the back or non-adhesive side of the lower tape passes in contact around the periphery of a lower, tape applicator roll 70, also formed of resilient material and driven to rotate in a counter-clockwise direction as indicated by the arrow "E" as the lower tape is applied. The lower tape applicator roller is mounted on an axle 72 having opposite ends journaled in a pair of replaceable bearing sleeves 74 fixedly mounted in apertures provided in the sidewalls 62 as shown in FIGS. 3 and 6.

As indicated in FIGS. 3 and 6, the upper and lower applicator rollers 52 and 70 bias the respective upper and lower tapes 30 with their adhesive covered sides facing against the respective upper and lower surfaces of metal flashing elements 26 and 28. The tape rollers pinch the upper and lower tapes against the moving metal elements and firmly secure the tapes in place to provide a structural, heat insulating interconnection between the inner and outer metal elements of the flashing strip 10. Biasing force exerted between the opposed pinching rollers is adjustably controllable by the threaded bias screws 56 in order to provide a desired amount of pressure for activating the pressure sensitive adhesive layer on the upper and lower joining tapes 30.

In accordance with the invention, a guide way structure 38 provides support for parallel alignment of the upper and lower surfaces of the respective inner and outer metal elements 26 and 28 and for this purpose, the side walls 62 of the lower tape applicator 36 are formed with a pair of oppositely outwardly extending, horizontal flanges 62*c* which form a bottom wall or base for the moving metal elements 26 and 28 as shown.

As illustrated best in FIGS. 5 and 6, each flange 62*c* is formed with a plurality of elongated slots 63 extending inwardly at right angles towards a center line between the parallel paths of the moving metal elements 26 and 28. The slots 63 are adapted to accommodate the shanks of upstanding cap screws 78 extended through the slots and threadedly engaging elongated guide fences 80 and 82 used for guiding outer edges of the metal flashing elements as they move through the apparatus.

The precise positioning of the guide fences may be adjusted as desired to provide the most desirable running clearances as illustrated in FIGS. 4, 5 and 6. In order to maintain the desired amount of clearance or spacing to form the air space 29 between the facing edges 26*d* and 28*a* of the respective metal flashing elements 26 and 28 as they move between the upper and lower tape applicators 34 and 36, the guide way system 38 includes a T-shaped, spacing element 84 having an upstanding spacing tongue or fence 84*a* disposed to lie between the running edges 26*d* and 28*a* of the inner and outer metal flashing elements. The spacing tongue extends upwardly above the upper surface of the metal flashing elements a short distance as illustrated in FIG. 4 to insure that proper spacing is maintained. The spacer includes an enlarged base 84*b* which is secured to the underside of the horizontal wall flanges 62*c* by pairs of upstanding cap screws 86. The particular T-shaped guide element 84 can readily be replaced or services by removing the cap screws. From time to time as the guide spacer 84*a* becomes worn, the spacer 84 may require replacement or repair.

In FIG. 7, the apparatus is illustrated utilizing a modified form of spacer 84A having an upstanding spacing tongue or fence 84*a'* of greater width or thickness than the fence 84*a* and adapted to provide a different spacing distance between the running edges of a pair of modified L-shaped metal elements such as indicated by the numbers 26A and 28A and which are joined together with a pair of upper and lower tape strips 30 to form a modified form of heat insulating structural or flashing member.

The apparatus as described in accordance with the present invention can be readily changed and adapted for the production of heat insulating type flashing members or other structural members which are joined together by a heat insulating tape(s) and these members may have a wide range of different cross-sectional shapes.

Although the present invention has been described with reference to several illustrated embodiments thereof, it should be understood that numerous other modifications and embodiments can be devised by those skilled in the art that will fall within the spirit and scope of the principles of this invention.

What is claimed as new and desired to be secured by Letters Patent of the United States is:

1. Insulated flashing comprising:

an inner metal element having an outer edge and an upstanding flange;

an outer metal element having an inner edge in spaced apart relation with said outer edge; and a joining element of insulating material continuously interconnecting said metal elements between said spaced apart edges.

2. The insulated flashing of claim 1 wherein said joining element comprises a strip of plastic tape adhesively secured to said metal elements.

3. The insulated flashing of claim 1 or 2 wherein said metal elements includes coplanar faces intersecting said edges and said tape is adhesively secured to said faces.

4. The insulated flashing of claim 3 wherein each of said metal elements includes a pair of said faces on opposite sides and said joining element includes a pair of said tape strips, each strip adhesively secured to a pair of coplanar faces of said metal elements.

5. The insulated flashing of claim 4 wherein said pair of tape strips are spaced apart between said spaced apart edges of said metal elements defining an insulating air space therebetween.

6. The insulated flashing of claim 1 wherein said upstanding flange is formed along an inside edge of said inner metal elements.

7. The insulated flashing of claim 1 wherein said upstanding flange includes a stiffening rib along an upper edge.

8. The insulated flashing of claim 1 or 7 wherein said inner metal element comprises an elongated aluminum extrusion.

9. The insulated flashing of claim 1 or 2 wherein at least one of said inner and/or outer metal elements is formed of extruded aluminum.

10. The insulated flashing of claim 1 or 2 wherein said joining element is formed of polyvinyl chloride.

11. The insulated flashing of claim 1 or 2 wherein said joining element is formed of polyethylene.

12. The insulated flashing of claim 1 or 2 wherein said joining element comprises a strip of tape having an adhesive layer on one face secured to said metal elements.

13. The insulated flashing of claim 12 wherein said adhesive layer comprises a rubber based adhesive material.

14. The insulated flashing of claim 12 wherein said adhesive layer comprises a low-creep snythetic adhesive material.

15. The insulated flashing of claim 12 wherein said adhesive layer comprises a pressure sensitive adhesive.

16. Insulated flashing comprising:

an inner metal element having an outer edge;

an outer metal element having an inner edge in spaced apart relation with said outer edge and including a downwardly deflectable drip edge along an outer edge; and a joining element of insulating material continuously interconnecting said metal elements between said spaced apart edges.

17. The insulated flashing of claim 16 wherein said outer element is formed with a groove to form a bend line to facilitate downward deflection of said drip edge.

18. The insulated flashing of claim 16 or 17 wherein said outer metal element comprises an elongated aluminum extrusion.

* * * * *